United States Patent [19]

Ishizaki

[11] 3,999,257

[45] Dec. 28, 1976

[54] SOCKET MEMBER FOR SNAP FASTENER

[76] Inventor: Hidenosuke Ishizaki, 6-13, 6-chome, Motoyamakita, Higashinada, Kobe, Japan

[22] Filed: Aug. 11, 1975

[21] Appl. No.: 603,507

[30] Foreign Application Priority Data

Oct. 1, 1974 Japan ..... 49-119158

[52] U.S. Cl. ..... 24/218; 24/216

[51] Int. Cl.[2] ..... A44B 17/00

[58] Field of Search ..... 24/218, 216, 220, 217 W

[56] References Cited

UNITED STATES PATENTS

| | | | |
|---|---|---|---|
| 1,196,009 | 8/1916 | Marinsky | 24/218 |
| 1,236,116 | 8/1917 | Smith | 24/218 |
| 1,281,904 | 10/1918 | Brell | 24/218 |
| 1,366,574 | 1/1921 | Lundstrom | 24/218 |
| 1,562,190 | 11/1925 | Reiter | 24/216 |
| 2,368,100 | 1/1945 | Boenecke | 24/216 |
| 3,540,086 | 11/1970 | Nysten | 24/216 |

FOREIGN PATENTS OR APPLICATIONS

| | | | |
|---|---|---|---|
| 510,301 | 11/1926 | Germany | 24/218 |
| 350,977 | 6/1921 | Germany | 24/218 |
| 265,179 | 2/1950 | Switzerland | 24/218 |
| 475,802 | 11/1937 | United Kingdom | 24/218 |

*Primary Examiner*—Bernard A. Gelak
*Attorney, Agent, or Firm*—Larson, Taylor and Hinds

[57] ABSTRACT

Socket member comprising a main body having a cavity portion formed in the center of its top wall for receiving the head of a stud member and bores for fastening the socket member formed around the cavity portion. The outer edge defining each of the bores is recessed so as to render the socket member easy to fasten to fabric and to prevent sewing thread or like fastening element from protruding from the upper surface of the main body.

3 Claims, 5 Drawing Figures

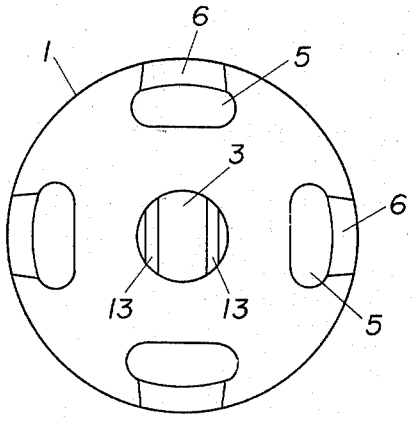
Fig. 1
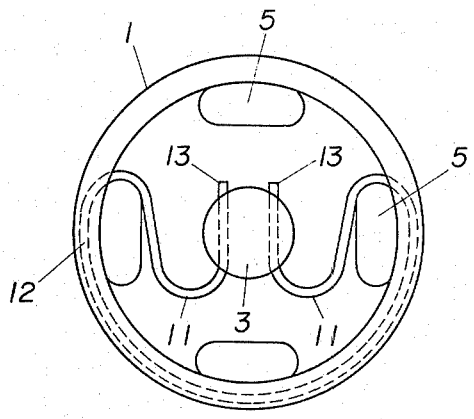
Fig. 2
Fig. 3
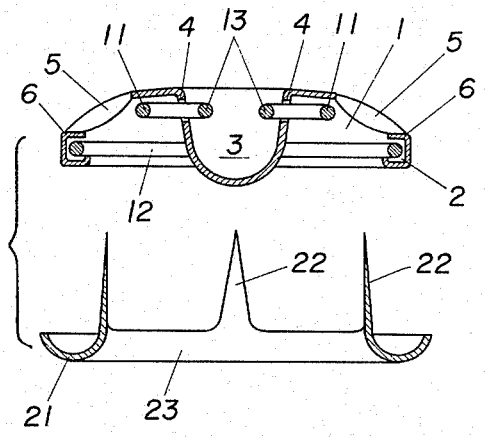

SOCKET MEMBER FOR SNAP FASTENER

BACKGROUND OF THE INVENTION

The present invention relates to improvements in a socket member for a snap fastener.

Generally the socket member of a snap fastener is fastened to a fabric by stitching or using an attaching member including an annular seat and prongs extending from the outer periphery of the seat. In the former case, a sewing needle is passed through fastening bores formed along the outer periphery of the socket member to fasten the socket member to the fabric. In the latter case, the socket member is placed on one side of the fabric with the attaching member positioned on the other side, and the prongs of the attaching member are pierced through the fabric. The prongs are then bent inward along the outer periphery of the socket member and inserted into the bores to fasten the socket member to the fabric.

However since the fastening bores are formed in the substantially horizontal top wall of the socket member and are positioned at the same level as the top wall, it is difficult to smoothly pass the needle through the bores for stitching or to bend the prongs of the attaching member. Thus the conventional socket member is not easy and inefficient to fasten in place. Moreover the stiches or bent portions of the prongs protruding from the upper surface of the fastened socket member are objectionable to the intimate engagement between the socket member and stud member of snap fastener. It is further noted that when worn out, the stitches are broken and the socket member will be lost or the fastening prongs tend to damage the fabric.

When the socket member is fastened to the fabric with the attaching member as described above, the hole formed in the fabric by the pierced prong is invariably located at the outermost position of the portion where the socket member is attached, with the result that when the fabric is frequently tensioned through repeated use of the snap fastener, the fabric is apt to be torn outward from the hole.

SUMMARY OF THE INVENTION

A primary object of this invention is to provide a socket member for a snap fastener which can be readily fastened to fabric with stitches or attaching member and which, once fastened in place, is effectively prevented from dropping due to the break of stitches or which does not permit the prongs of the attaching member to damage the fabric, the socket member further being adapted for effective intimate engagement with the stud member of snap fastener.

Another object of this invention is to provide a socket member for a snap fastener which, when fastened to fabric by the prongs of an attaching member, will not permit the prong to tear the fabric outward from the portion where it is positioned even when the fabric is pulled through the repeated use of the snap fastener.

The socket member of this invention for use in a snap fastener comprises a main body having a cavity portion formed in the center of its top wall for receiving the head of a stud member, the main body having a plurality of fastening bores formed around the opening of the cavity portion, the outer edge defining each of the fastening bores being recessed to provide the bore with a slanting opening extending downward outwardly of the main body.

The fastening bores are utilized for fastening the socket member to fabric by stitching or using an attaching member having an annular seat and a plurality of upright prongs extending from the seat. As compared with the conventional socket member in which the fastening bores are formed in its top wall at the same level as the wall, the socket member of this invention is more advantageous in assuring smooth, easy and efficient work when a needle is passed through the bores for stitching or when the prongs of the attaching member passed through the bores are bent over the periphery of the main body.

Further when the fastening bores are utilized for fastening the socket member to fabric by stitching or using the attaching member, the recessed outer edges defining the bores prevent the stitches or the bent portions of the prongs from protruding from the upper surface of the socket member, thereby further preventing the socket member from dropping if the stitches are worn out and broken and also eliminating the possible damage to the fabric to be otherwise caused by the bent portions of the prongs. In addition the recessed edges assure intimate engagement between the socket member and stud member of the snap fastener.

According to one aspect of this invention, the socket member is fastened to fabric by an attaching member having an annular seat and a plurality of upright prongs extending from the inner periphery of the seat. At this time, the socket member is placed on one side of the fabric with the attaching member positioned on the other side, and the prongs of the attaching member are passed through the fabric and the fastening bores. The projecting portions of the prongs are then bent outward to fasten the socket member to the fabric. The socket member thus attached in place has the following advantage. The hole formed by each of the prongs pierced through the fabric is positioned inside the outer peripheral edge of the annular seat. Consequently, the outer peripheral edge of the annular seat is held in intimate contact with the fabric, this positively preventing the fabric from tearing outward from the hole even when the fabric is tensioned due to frequent use of the snap fastener.

For a better understanding of this invention an embodiment will be described below with reference to the accompanying drawings.

BRIEF DESCRIPTION OF THE DRAWINGS

FIG. 1 is a plan view showing a socket member for a snap fastener according to this invention;

FIG. 2 is a bottom view of the same;

FIG. 3 is a central vertical section showing the socket member and an attaching member therefor;

DESCRIPTION OF THE PREFERRED EMBODIMENT

Figure 4:
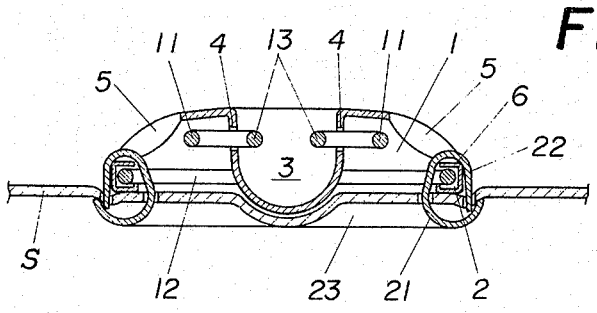
FIG. 4 is a central vertical section showing the socket member as fastened to fabric by the attaching member.

The socket member of snap fastener of this invention comprises a main body 1 and a resilient bent wire 11 shown in FIG. 2.

The main body 1 has an inwardly open peripheral groove 2 formed by inwardly bending the lower edge of downwardly extending peripheral annular wall, a cavity portion 3 formed in the center of top wall of the main body 1 for receiving the head of a stud member, two opposing parallel slits 4 formed in the upper part of the cavity portion 3, and a plurality of fastening bores 5 formed around and equidistantly spaced apart from the cavity portion 3. An outer edge 6 defining each of the fastening bores 5 is recessed by press work to provide the bore 5 with a slanting opening which extends downward outwardly of the main body 1.

The resilient bent wire 11 is formed of a steel wire spring which is bent into a symmetrical shape on the right and left. The resilient wire 11 comprises a curved main portion 12 and two straight portions 13 formed at the opposite ends of the wire.

The curved main portion 12 of the resilient wire 11 is forced into the peripheral groove 2 of the main body 1, and the straight portions 13 are inserted from outside into the two slits 4 in the cavity portion 3, whereby the straight portions 13 are retained in parallel in the cavity portion 3 as spaced apart from each other by a specified distance. The two straight portions 13 are adapted to nip and elastically contact the neck of the stud member to be inserted into the cavity portion 3.

Figure 5:
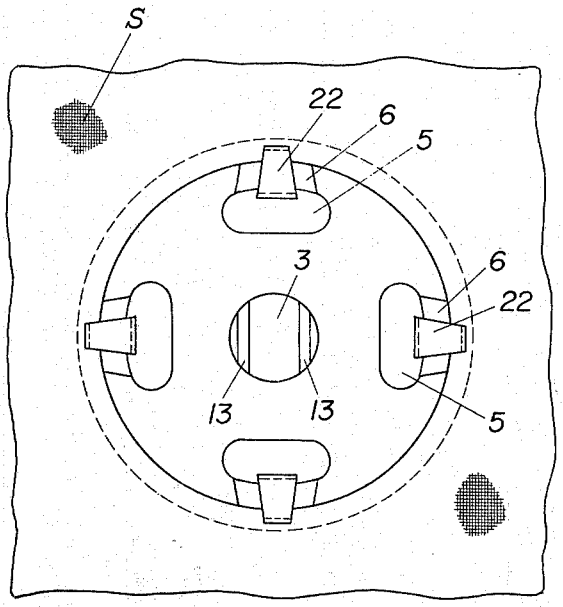
FIG. 5 is a plan view showing the same as fastened in place.

The socket member having the above construction according to this invention is fastened to the fabric by stitching the recessed outer edges 6 thereto although not shown. Alternatively as shown in FIG. 3, it is attached to the fabric using an attaching member 23 including an annular seat 21 and upright prongs 22 identical with the fastening bores 5 in number and extending from the inner peripheral edge of the seat 21. The annular seat 21 has a concave circular arc cross section. More specifically with reference to FIGS. 4 and 5, the prongs 22 of the attaching member 23 are pierced through the fabric S from one side to the other side thereof at the specified position. The projecting portions of the prongs are then passed through the fastening bores 5 from the rear side of the socket member. Using suitable means, the projecting portions of the prongs 22 are then bent outward over the recessed outer edges 6. As illustrated, the sharp ends of the prongs 22 may further be pieced through the fabric S and forced into the concave portion of the annular seat 21. In this way the socket member is effectively fastened to the fabric.

It should be understood that the principal embodiment of this invention described above is given merely for the illustrative purposes and that the present invention is not limited only to this mode of embodiment. It will be possible for those skilled in the art to provide various modifications other than the foregoing, but such modifications may be included in the present invention insofar as they do not depart from the scope of the claims set forth below.

What is claimed is:

1. A socket member for a snap fastener comprising:

a main body having a convexly curved outer surface with a cavity formed into its center for receiving the head of a stud member, a circular edge portion having a side wall adjacent the edge of the convexly curved outer surface and a flange extending from said side wall radially inwardly, said flange being spaced from the convexly curved outer surface by means of said side wall, a plurality of fastening bores formed in the said outer surface, at least the outermost edge of each bore being recessed inwardly relative to the convex curvature of the said outer surface, and an attaching member having an annular seat which is concave toward the main body and which includes a plurality of prongs on the radial inner periphery thereof, each prong being aligned with a fastening bore of the main body, and the annular concave seat being aligned with the said flange of the main body, said prongs passing through their respective fastening bore and bent over the outermost edge of their respective bores and over the side wall of the main body with the attaching member drawn toward the main body to clamp a layer of material therebetween, and to secure the main body to the layer of material by cooperation of the outer periphery of the annular seat and the juncture of the side wall and the flange, while the prongs pass through the layer of material radially inwardly of said juncture.

2. A socket member according to claim 1, wherein the ends of the prongs, after passing through the fastening bores, are turned toward the layer of material and further pierce the same.

3. A socket member according to claim 1, including spring means located against the inside of the side wall and including means for resiliently yielding to resiliently receive and hold the stud of a snap fastener.

* * * * *